US010062482B2

(12) United States Patent
Zhou et al.

(10) Patent No.: US 10,062,482 B2
(45) Date of Patent: Aug. 28, 2018

(54) RAPID CONSOLIDATION METHOD FOR PREPARING BULK METASTABLE IRON-RICH MATERIALS

(71) Applicant: GM GLOBAL TECHNOLOGY OPERATIONS LLC, Detroit, MI (US)

(72) Inventors: Chen Zhou, Troy, MI (US); Frederick E. Pinkerton, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 398 days.

(21) Appl. No.: 14/834,861

(22) Filed: Aug. 25, 2015

(65) Prior Publication Data

US 2017/0062106 A1 Mar. 2, 2017

(51) Int. Cl.

| | |
|---|---|
| ***H01F 1/059*** | (2006.01) |
| ***H01F 1/055*** | (2006.01) |
| ***H01F 41/02*** | (2006.01) |

(52) U.S. Cl.

CPC ..... *H01F 1/0593* (2013.01); *H01F 1/0557* (2013.01); *H01F 41/0266* (2013.01)

(58) Field of Classification Search

None

See application file for complete search history.

(56) References Cited

U.S. PATENT DOCUMENTS

| | | | | |
|---|---|---|---|---|
| 5,478,411 | A | 12/1995 | Coey et al. | |
| 6,419,759 | B1 * | 7/2002 | Yang | C22C 1/0441 148/301 |
| 2001/0020495 | A1 | 9/2001 | Mei et al. | |
| 2014/0251500 | A1 | 9/2014 | Zhou et al. | |
| 2016/0322136 | A1 * | 11/2016 | Kelhar | H01F 1/0577 |

FOREIGN PATENT DOCUMENTS

| | | | |
|---|---|---|---|
| CN | 1059230 | A | 3/1992 |
| CN | 1961388 | A | 5/2007 |
| DE | 69118577 | T2 | 11/1996 |
| JP | 04365840 | A | 12/1992 |
| WO | 2005066980 | A2 | 7/2005 |

OTHER PUBLICATIONS

Richman (Journal of Electronic Materials, 1997, vol. 26, p. 415-422).*

Zhou (Journal of Magnetism and Magnetic Materials, 2014, vol. 369, p. 127-131, published online on Jun. 19, 2014).*

(Continued)

*Primary Examiner* — Xiaowei Su

(74) *Attorney, Agent, or Firm* — Reising Ethington P.C.

(57) ABSTRACT

Interstitially modified compounds of rare earth element-containing, iron-rich compounds may be synthesized with a $ThMn_{12}$ tetragonal crystal structure such that the compounds have useful permanent magnet properties. It is difficult to consolidate particles of the compounds into a bulk shape without altering the composition and magnetic properties of the metastable material. A combination of thermal analysis and crystal structure analysis of each compound may be used to establish heating and consolidation parameters for sintering of the particles into useful magnet shapes.

7 Claims, 2 Drawing Sheets

(56) References Cited

OTHER PUBLICATIONS

Chen Zhou et al.; Magnetic properties of CeFe11-xCoxTi with ThMn12 structure; Journal of Applied Physics 115, 17C716 (2014); doi: 10.1063/1.4863382; published by the American Institute of Physics.

Chen Zhou et al; Magnetic hardening of Ce1+xFe11-yCoyTi with ThMn12 structure by melt spinning; Journal of Applied Physics 117, 17A741 (2015); doi: 10.1063/1.4918562; Published by the American Institute of Physics.

* cited by examiner

RAPID CONSOLIDATION METHOD FOR PREPARING BULK METASTABLE IRON-RICH MATERIALS

This invention was made with U.S. Government support under Agreement No. DE-AR0000195 awarded by the Department of Energy. The U.S. Government may have certain rights under this invention.

TECHNICAL FIELD

This disclosure pertains to the making of useful densified bulk shapes by rapid consolidation of particles of interstitially modified compounds of rare earth element-containing, iron-rich compositions having permanent magnet properties provided by a $ThMn_{12}$ tetragonal crystal structure.

BACKGROUND OF THE INVENTION

There is a need for permanent magnet materials in electric motors of many sizes and other electrically powered articles of manufacture. Rare earth element-containing and iron-rich permanent magnets may be useful and relatively inexpensive, particularly when the rare earth element constituent comprises cerium, the most abundant element of the rare earth group. However, there remains a need to develop processes by which compounds of rare earth elements and iron can be prepared in particulate form with desirable permanent magnet properties, and by which said particulates can be consolidated to form useful densified bulk magnets that retain the desirable permanent magnet properties.

SUMMARY OF THE INVENTION

This invention provides a process for rapidly consolidating small particles (often comminuted as powder) of metastable permanent magnet compounds of rare earth element-containing, iron-rich compositions into dense bulk parts suitable for magnet applications without thermal degradation of the functional properties of the compounds. A volume of the particles is compacted in a suitable die and a pulsed direct current (DC) is passed through the compacted particles to heat and sinter them into a densified shape. By using such a spark plasma sintering (SPS) technique and carefully selecting the processing parameters, powders, or like small particles, of metastable permanent magnet compound compositions can be consolidated into bulk shapes at temperatures above their thermodynamic stability limit to achieve nearly full density in the desired finished shape of a magnet. SPS enables densification of the metastable compound particles at reduced temperatures and shorter times than other densification techniques such as hot pressing or conventional sintering, thus avoiding decomposition or degradation and preserving the original desired functional attributes of the material.

In accordance with embodiments of this invention, the spark plasma sintering process is applied to powder particles of interstitially modified rare earth-iron compounds with a $ThMn_{12}$ type tetragonal crystal structure (sometimes hereafter referred to as the 1-12 crystal structure) in the overall composition of $(Ce_{1-x}R_x)_{1+w}Fe_{12-y}M_yN_z$. As specified in more detail below in this specification, the elements designated by N are the interstitial modifying elements in the crystal structure of the compound. This composition is further specified as follows.

The value of x is suitably in the range of 0 thru 1, and preferably in the range of 0.6 thru 1. In general it is preferred that some cerium is included in the composition, but cerium is not required. The value of w is suitably in the range of −0.1 thru 0.3 and preferably in the range of 0.05 thru 0.15.

R is one or more rare earth elements (in addition to cerium) selected from La, Pr, Nd, Sm, Eu, Gd, Tb, Dy, Ho, Er, Tm, Yb, and Lu. R may also include yttrium (Y).

Element M is one or more of Mo, Ti, V, Cr, B, Al, Si, P, S, Sc, Co, Ni, Zn, Ga, Ge, Zr, Nb, Hf, Ta, or W. The M element(s) is selected and used in combination with R and Fe to form a compound having the 1-12 tetragonal crystal structure. As indicated in the equation of above composition, the M element(s) is used in place of a portion of the iron content. The value of y is suitably in the range of 1 thru 4 (including fractional intermediate values), and preferably in the range of 1 thru 2.

Element N is an optional interstitial element in the crystal structure formed by the R, Fe, and M elements, and, when used in the compound, is preferably nitrogen, but may be any one or more of hydrogen, carbon, and nitrogen. The value of z is suitably in the range of 0 thru 3 and preferably in the range of 0.5 thru 1.5. The optional interstitial element(s) is employed so as to complement the required 1-12 crystal structure.

Carbon may be incorporated into the R—Fe-M compound as it is initially formed. Carbon may be added in the form of a carbon compound to a melt of R, Fe, and M elements such that the carbon compound is decomposed in the melt to form the R—Fe-M compound with carbon atoms located interstitially in the 1-12 crystal structure. Nitrogen is incorporated into a previously formed R—Fe-M compound by a gas phase interstitial modification with nitrogen gas, also known as nitrogenation. Hydrogen may be incorporated into the R—Fe-M compound by a gas phase interstitial modification (e.g., hydrogenation) in a manner analogous to the described introduction of nitrogen.

In preferred embodiments of the invention, the $(Ce_{1-x}R_x)_{1+w}Fe_{12-y}M_y$ compound is initially formed by combining the R element(s), Fe, and M element(s) in a molten volume. If desired, carbon or precursors containing carbon may be added to the molten volume to immediately form the $(Ce_{1-x}R_x)_{1+w}Fe_{12-y}M_yN_z$ composition. The thoroughly mixed melt is then solidified in a suitable manner to form the crystalline 1-12 phase solid which is comminuted into the form of powder, or of like suitably small particles. For example, it is generally preferred that the comminuted particles have maximum diameters no greater than about forty-five micrometers preparatory to compaction and SPS sintering.

Some of the particulate 1-12 compounds may be formed by conventional solidification of the molten volume into an ingot and the ingot subsequently broken and comminuted into the powdered compound. In the case of other compound compositions it may be necessary to subject the molten volume to melt spinning or other suitable rapid solidification process to obtain flakes or other small particles of the $(Ce_{1-x}R_x)_{1+w}Fe_{12-y}M_y$ compound with the desired 1-12 crystal phase. In either practice, the resulting crystalline compound will be comminuted into powder, preferably having a particle size smaller than 45 m, and subjected to the nitrogenation, hydrogenation, or like gas-phase interstitial modification to form particles of $(Ce_{1-x}R_x)_{1+w}Fe_{12-y}M_yN_z$ possessing the same 1-12 crystal structure and without substantially increasing the size of the original $(Ce_{1-x}R_x)_{1+w}Fe_{12-y}M_y$ particles. The formed $(Ce_{1-x}R_x)_{1+w}Fe_{12-y}M_yN_z$ may be metastable to the extent that the powder particles cannot be casually heated and partially liquefied, for consolidation into a bulk shape for a permanent magnet article, such as a stator magnet for an electric motor. Under such thermal processing the compound is decomposed and 1-12 crystalline phase is transformed such that the material loses its permanent magnet properties. In accordance with practices of this invention, a careful thermal analysis, and related crystal structure analysis, of the compound is conducted to determine a suitable maximum temperature, heating period, and compaction pressure for compaction of the particles and short-term passage of a pulsed DC current through the particles to quickly sinter them into a bulk shape, without modification of their essential 1-12 crystal structure. It may be possible to determine suitable SPS parameters for a specific composition by trial and error processing of sample specimens, but it is preferred to use more careful thermal analysis practices, combined with crystal structure analyses, as described further in this specification.

In accordance with SPS practices of this invention, particles of the 1-12 phase permanent magnet compound are placed in a suitable die defining a desired bulk magnet shape, compacted under suitable pressure in an oxygen free environment, and heated by the passage of a pulsed direct current (DC) directly through the mass of compacted powder particles to form a consolidated body having a density of ninety percent or more of the density of the $(Ce_{1-x}R_x)_{1+w}Fe_{12-y}M_y$ or $(Ce_{1-x}R_x)_{1+w}Fe_{12-y}M_yN_z$ compound. The passage of the DC current is managed to heat the compacted particles for a predetermined time and to a predetermined temperature so as to achieve the consolidation of the bulk shape without substantial alteration of the crystalline properties and magnetic properties of the initial particles of the formed $(Ce_{1-x}R_x)_{1+w}Fe_{12-y}M_y$ or $(Ce_{1-x}R_x)_{1+w}Fe_{12-y}M_yN_z$ compound.

As stated, this direct heating consolidation of the particles of metastable 1-12 compound is called spark plasma sintering (sometimes SPS in this text) because the initial passage of the DC current is considered likely to initially produce sparks and a plasma within the small voids in the initial compacted body of particles. But, whatever the bonding mechanism, the pressure on the compacted particles, the non-oxidizing environment, and the managed flow of DC current through the particles is used to quickly sinter them, within a period of a few minutes (dwelling time), into a substantially void-free structure of predetermined shape for use of the magnetic properties of the selected 1-12 phase compound. Further illustrative examples of forming particles of the compounds, the thermal and crystal structure analyses of the compound, and the consolidation of the particles are presented below in this specification. The illustrative examples are not intended to be limitations of the scope of the invention.

BRIEF DESCRIPTION OF THE DRAWINGS

FIG. 3 (*b*) is the demagnetization curve of the spark plasma sintered bulk $(Ce_{0.2}Nd_{0.8})_{1.1}Fe_{10.5}Mo_{1.5}N_{1.3}$ magnet SPS-600 measured at 400 K (127° C.).

DESCRIPTION OF PREFERRED EMBODIMENTS

Interstitially modified rare earth-iron magnet powder with $ThMn_{12}$ type crystal structure is prepared in the form of $(Ce_{1-x}R_x)_{1+w}Fe_{12-y}M_yN_z$ in which suitable R elements, M elements, and N elements are described and specified in the Summary section of this specification. Suitable and preferred value ranges for x, w, y, and z are also specified in the Summary section. As stated, in the case of many compounds, the formed powder particles of the $(Ce_{1-x}R_x)_{1+w}Fe_{12-y}M_yN_z$ compound will not retain their essential 1-12 crystal structure if they are overheated or retained at an elevated temperature too long. A compacted volume of the prepared rare earth-iron magnet powder is consolidated into a densified bulk magnet body using a sintering process in which a pulsed direct electric current (DC) is passed directly through the compressed body of powder as it is held and compacted in a forming die. A suitable spark plasma sintering process may be used to consolidate the powder and retain substantially the same permanent magnet properties produced in the original powder.

In a specific illustrative example, a selected preformed $(Ce_{1-x}R_x)_{1+w}Fe_{12-y}M_y$ compound powder or a selected preformed $(Ce_{1-x}R_x)_{1+w}Fe_{12-y}M_yN_z$ powder, either having the 1-12 crystal structure, is loaded in a graphite or metal die and consolidated by a Spark Plasma Sintering (SPS) technique as described herein. Compared to other consolidation methods such as liquid phase sintering or hot pressing, SPS uses the joule heating from high pulsed DC electric current directly passed through the green compact, thereby enabling the rapid sintering of dense samples at reduced temperature. The compound powder is held under pressures of, for example, 60-120 MPa while the holding time at the selected maximum sintering temperature is up to five to ten minutes. For example, the DC current is suitably pulsed at a rate of, e.g., 70 Hertz, with a pulse duration of 12 ms, and a 2 ms pause. Current flow is controlled so as to quickly heat the compacted powder to a predetermined temperature level and no higher. For example, the temperature of the compacted powder may be increased at rates of 50 to 150 Celsius degrees per minute. The rapid sintering rate and reduced sintering temperature make SPS suitable for consolidating the metastable $(Ce_{1-x}R_x)_{1+w}Fe_{12-y}M_y$ or $(Ce_{1-x}R_x)_{1+w}Fe_{12-y}M_yN_z$ magnet powder that is susceptible to decomposition when protractedly exposed to elevated temperature.

Figure 1:
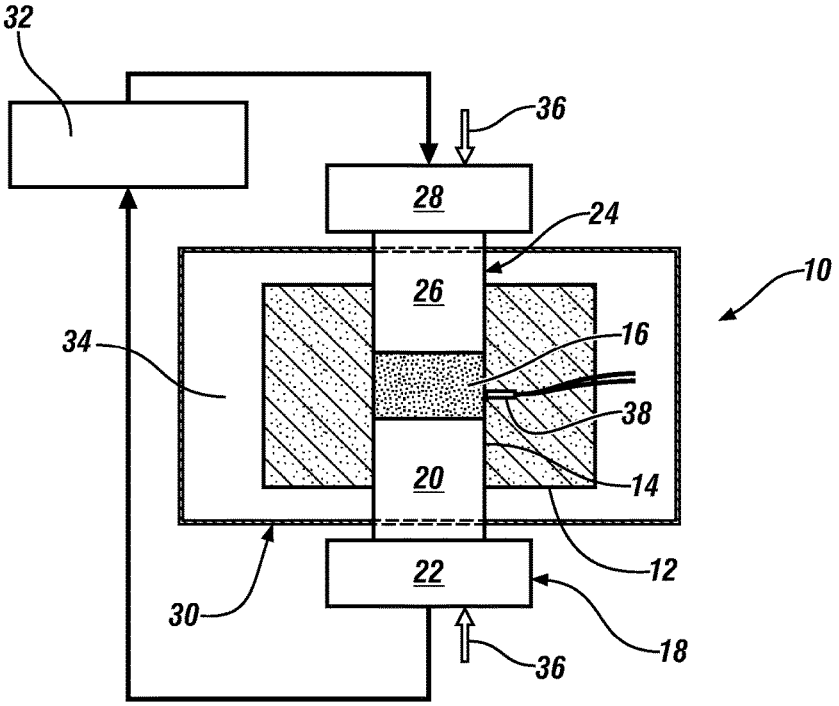
FIG. 1 is a schematic, front elevation view of a die with a cylindrical cavity in which interstitially-modified rare earth-iron magnet powder with $ThMn_{12}$ type crystal structure is compacted in the round cylindrical cavity of a die between diametrically opposing, upper and lower punches. The die cavity is enclosed so as to provide and maintain the powder in an oxygen-free environment. Means is provided for detecting the temperature of the magnet powder and for passing a pulsed direct current directly through the compacted powder to quickly sinter it into a dense cylinder magnet body.

An example of a SPS type sintering apparatus 10 for sintering the metastable modified rare earth-iron powder is illustrated in FIG. 1. In this illustration, sintering apparatus 10 comprises a round graphite die 12 with a vertical open-ended round cylindrical cavity 14 sized for holding a predetermined volume of the metastable R—Fe-M or R—Fe-M-N powder 16. In an illustrative example described below in this specification the composition of the powder was $(Ce_{0.2}Nd_{0.8})_{1.1}Fe_{10.5}Mo_{1.5}N_{1.3}$.

The lower end of vertical cavity 14 was closed by the round shaft 20 of lower stainless steel punch 18. Round shaft 20 was sized to fit closely, but movably, in die cavity 14 for applying compaction pressure and, if desired, to conduct DC electrical current to the volume of rare earth-iron compound powder 16. Shaft 20 supported the lower portion of the volume of rare earth-iron powder 16. Punch 18 also has a larger diameter round head 22 for application of pressure (and if desired an electrical current) to the volume of powder 16. Upper stainless steel punch 24 was sized and shaped like lower punch 22. Upper punch 24 comprised round shaft 26 and round head 28 which served functions complementary, but directionally opposing, to punch 22. The cross-hatched rectangle indicates the potential use of a chamber 34, or the like, around the powder volume 16 for isolating it from an oxidizing atmosphere or other atmosphere that could alter the composition and crystal structure of the modified rare earth-iron composition being compacted. Chamber 34 may be evacuated to a suitable level of vacuum or back-filled with a protective, non-oxidizing gas such as, for example, nitrogen or argon.

Means indicated by un-filled arrows 36 is provided to provide a very substantial compacting force (e.g., 60 MPa to 110 MPa) to punches 20, 26. And means 32 is provided to direct a substantial pulsed DC current (indicated by solid lines with a directional arrow leading to punches 18, 24) through the powder volume 16 to directly heat the powder as pressure is applied to the powder by the opposing compacting action of punches 20, 26. Also, a thermocouple 38, or other suitable temperature sensing means, may be placed in the die for timely and continuous sensing of the temperature of the powder 16 as it is being compacted and sintered. Such temperature measurements may be used to manage the amount and duration of pulsed DC current through the powder 16 as it is being consolidated without altering its composition or crystal structure, or appreciably diminishing the magnetic properties of the powder placed in the die. At the completion of the SPS sintering process the current flow is stopped, the punches 20, 26 opened, and a shaped bulk permanent magnet body removed from cavity 14.

As an illustrative example, a powder of the composition, $(Ce_{0.2}Nd_{0.8})_{1.1}Fe_{10.5}Mo_{1.5}$, was prepared, having the 1-12 tetragonal crystal structure. The composition was to be subsequently nitrogenated. It was found that in order to develop hard magnetic properties of the described $(Ce_{1-x}R_x)_{1+w}Fe_{12-y}M_yN_z$ compounds with 1-12 tetragonal structure, it was necessary to form the compound by a rapid solidification process, specifically by melt spinning.

Melt-spun ribbons of $(Ce_{0.2}Nd_{0.8})_{1.1}Fe_{10.5}Mo_{1.5}$ were prepared by induction melting a stoichiometric mixture of pure elements (Ce, Nd, Fe, and Mo) into a homogeneous liquid volume. The liquid volume was formed in a suitable round bottom container, adapted to permit the controlled or measured withdrawal of a stream of the liquid from the bottom of the container. Then, a fine liquid stream was continually drained downwardly from the container of the liquid onto the circumferential rim of a 10 inch diameter, Cr plated, Cu wheel rotating at a surface wheel speed $v_s$=17.5 m/s. In such melt spinning operations, the flow rate of the descending molten liquid stream and the speed and mass of the quench wheel stream are coordinated to obtain a suitable rate of solidification of the liquid. The molten liquid volume was thus progressively rapidly quenched upon contact of the liquid stream with the rim of the spinning wheel to produce small, fragmented, solidified ribbons of the starting composition which were collected as they were thrown from the quench surface of the wheel. A relatively small volume of the molten liquid was prepared in this example, and it was not necessary to cool the rotating copper wheel because the volume of liquid was all solidified before the relatively massive copper wheel was appreciably heated above its initial ambient temperature. In processing a substantial volume of the molten rare earth-iron compound, however, it may be necessary to cool the quench wheel to assure suitably rapid solidification of the molten stream to obtain the necessary 1-12 crystal structure.

After cooling to ambient temperature, the collected ribbon particles were ball milled under argon and sieved to a particle size smaller than 45 m prior to nitriding. Nitriding, using pure nitrogen gas, was performed on the powder which had been placed in a Hiden Isochema Intelligent Gravimetric Analyzer (IGA). The nitriding parameters for $(Ce_{0.2}Nd_{0.8})_{1.1}Fe_{10.5}Mo_{1.5}$ were: nitriding pressure P=10 bar, time t=3~4 h, and temperature T=500° C. The nitrogen absorption is calculated from the weight difference before and after nitriding, assuming all nitrogen atoms go into the 1-12 phase. The nitride compound, $(Ce_{0.2}Nd_{0.8})_{1.1}Fe_{10.5}Mo_{1.5}N_{1.3}$ was formed. The particle size of the starting compound, $(Ce_{0.2}Nd_{0.8})_{1.1}Fe_{10.5}Mo_{1.5}$, was not appreciably increased by the addition of nitrogen, and the particles (powder) of the nitrided compound were considered ready for compaction.

When the magnetic compound is one with which there is no previous sintering experience, it is preferred (and usually necessary) to conduct thermal evaluation analyses and crystal structure analyses and compositional analyses of sample portions of the powder of a selected $(Ce_{1-x}R_x)_{1+w}Fe_{12-y}M_yN_z$ composition before spark plasma sinter processing the main portion of the powder in order to determine the temperature limit that will retain the 1-12 crystal structure and the permanent magnet properties in the consolidated bulk magnet body. Examples of such thermal and compositional analyses will be illustrated in the making of bulk magnets of the rapidly solidified and nitride powders of the $(Ce_{0.2}Nd_{0.8})_{1.1}Fe_{10.5}Mo_{1.5}N_{1.3}$ composition.

In summary, test sample bulk magnets of nominal composition $(Ce_{0.2}Nd_{0.8})_{1.1}Fe_{10.5}Mo_{1.5}N_{1.3}$ were sintered by a managed spark plasma sintering process in the temperature range of 550-700° C., compaction pressure range of 60-104 MPa, and using either nitrogen or argon as a protective atmosphere. The processing parameters and properties of the sintered compounds are summarized in the Table below in this specification. But, importantly, it was first necessary to predetermine sintering conditions for consolidation of the $(Ce_{0.2}Nd_{0.8})_{1.1}Fe_{10.5}Mo_{1.5}N_{1.3}$ powder without altering the composition or crystal structure of the compound with the 1-12 crystal structure.

Figure 2:
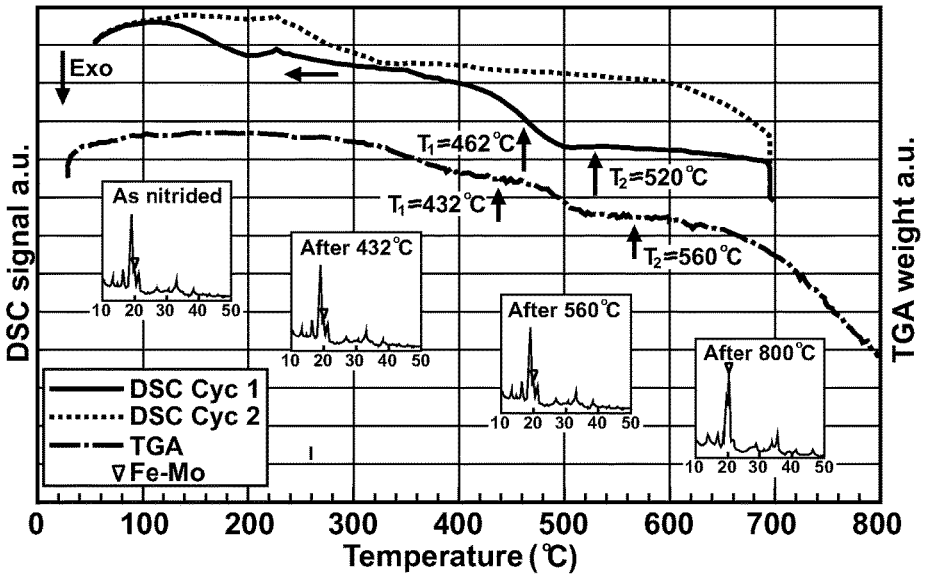
FIG. 2 is a graph displaying methods of thermal analysis of the compound, $(Ce_{0.2}Nd_{0.8})_{1.1}Fe_{10.5}Mo_{1.5}N_{1.3}$, over temperatures (abscissa) in the range from about room temperature to about 800° C., using differential scanning calorimetry (DSC, left ordinate, in arbitrary units) and thermogravimetry analysis (TGA, right ordinate, in arbitrary units). The DSC curves show the heat flow into or out of the specimen during heating. The TGA curve indicates changes in the weight of the sample with increasing temperature. The four boxes, inserted on the face of the graph, are x-ray diffraction patterns, respectively, of the "as-nitrided" sample after the nitriding treatment but before heating, the sample after heating at 432° C., the sample after heating at 560° C., and the sample after heating at 800° C. The inverted triangle symbol on each of the four x-ray diffraction patterns identify diffraction peaks indicative of the presence of an iron-molybdenum (Fe—Mo) impurity phase resulting from decomposition of the original $(Ce_{0.2}Nd_{0.8})_{1.1}Fe_{10.5}Mo_{1.5}N_{1.3}$ compound with the required 1-12 phase.

A combination of experimental techniques such as thermal and X-ray diffraction analysis and theoretical calculation based on a metal diffusion model have been used in order to establish the limits of sintering temperature. FIG. 2 displays the differential scanning calorimetry (DSC) and thermogravimetry analysis (TGA) results, together with X-ray diffraction patterns at temperatures corresponding to potential thermal events of the $(Ce_{0.2}Nd_{0.8})_{1.1}Fe_{10.5}Mo_{1.5}N_{1.3}$ powder.

As can be seen from FIG. 2, the DSC cycle 1 curve shows a broad exothermic peak that disappears in the DSC second cycle, but which lacks well defined sharp peaks throughout the heating from about 50° C. to 700° C. In FIG. 2, the arrow labeled "Exo" marks the direction of exothermic transformation, the magnitude of which is indicated in arbitrary units. From derivatives of the DSC cycle 1 curve, two inflection points were identified near 462° C. and 520° C. The DSC results are consistent with the TGA analysis.

X-ray analysis of post thermal cycling samples at the temperatures identified by TGA revealed no noticeable phase change in samples of the compound after heat treatment at 432° C. But X-ray analyses revealed a slight increase of a Fe—Mo impurity phase at 560° C., and decomposition of the 1-12 phase at 800° C. These findings suggested that the decomposition of $(Ce_{1-x}R_x)_{1+w}Fe_{12-y}M_yN_z$ is a kinetic process whose rate is determined by the diffusion of dominant metal element Fe.

Starting at the second inflection point of 520° C. identified in the DSC curve (shown in FIG. 2), samples of the as-nitrided, $(Ce_{0.2}Nd_{0.8})_{1.1}Fe_{10.5}Mo_{1.5}N_{1.3}$, powder were annealed for 3, 9, 27, and 81 minutes, respectively, and X-ray diffraction patterns of the annealed samples were prepared and analyzed. Then a calculation was made of the annealing temperature T that would make a Fe atom diffuse the same distance in 3 min as it does in 81 min when annealed at 520° C., using the equation:

$$2\sqrt{(Dt)}|_{t=81min,T=520°\ C.} \approx 2\sqrt{(Dt)}|_{t=3min,T=596°\ C.}$$

where $D=D_0\ \exp(-E_a/kT)$ is the diffusion coefficient at temperature T, $D_0=1.0\ mm^2/s$, $E_a=250$ kJ/mol is the activation energy, and t is time. In this way, it can be estimated that annealing at 596° C. for 3 min is equivalent to annealing at 520° C. for 81 min, and annealing at 687° C. for 3 min is equivalent to annealing at 596° C. for 81 min. Samples of $(Ce_{0.2}Nd_{0.8})_{1.1}Fe_{10.5}Mo_{1.5}N_{1.3}$ powder were repeatedly annealed for 3-81 min at increasing temperature set points estimated by the above method until significant Fe—Mo impurity phase, the byproduct of 1-12 phase decomposition, could be observed in the X-ray diffraction pattern.

In furtherance of the thermal analysis, a series of X-ray diffraction patterns were obtained after annealing for periods of 3 minutes, 9 minutes, 27 minutes and 81 minutes at each of 520° C. (793 K), 596° C. (869 K), and 687° C. (960 K), respectively. Analysis of the respective patterns showed that $(Ce_{0.2}Nd_{0.8})_{1.1}Fe_{10.5}Mo_{1.5}N_{1.3}$ is stable at 520° C. and that the diffraction pattern after 81 min heating showed no noticeable difference compared to that of the as-nitrided sample. Annealing at 596° C. accelerates the decomposition process as the intensity of the Fe—Mo peak shows a small but discernible increase with increasing annealing time. At 687° C., $(Ce_{0.2}Nd_{0.8})_{1.1}Fe_{10.5}Mo_{1.5}N_{1.3}$ decomposes at a much faster pace as characteristic peaks associated with the unwanted Fe—Mo phase can be easily observed after only 3 min.

The above-described annealing tests suggested that there exists an opportunity window to sinter $(Ce_{0.2}Nd_{0.8})_{1.1}Fe_{10.5}Mo_{1.5}N_{1.3}$ up to 687° C. and the bulk magnet may retain reasonable extrinsic magnetic properties if the sample can be sintered in a few minutes. It is for this reason that SPS is chosen to consolidate $(Ce_{0.2}Nd_{0.8})_{1.1}Fe_{10.5}Mo_{1.5}N_{1.3}$, as heating and cooling rates of up to 1000° C./min can be achieved in this advanced sintering method.

A series of powder samples were sintered by SPS at temperatures in the range of 500-700° C. and X-ray diffraction patterns of bulk $(Ce_{0.2}Nd_{0.8})_{1.1}Fe_{10.5}Mo_{1.5}N_{1.3}$ magnets were obtained. It was found that the bulk magnets sintered between 550 and 650° C. maintained a major 1-12 phase, while the one sintered above 675° C. showed significant decomposition into Fe—Mo and Fe based nitrides.

To better assess the phase change during annealing and SPS, Bruker Diffrac Plus Evaluation software was used to analyze the diffraction patterns obtained on the sintered samples and to plot the semi-quantitative phase percentage as functions of holding time and heating temperature. It was concluded that at sinter temperatures below or at 596° C. (869 K), $(Ce_{0.2}Nd_{0.8})_{1.1}Fe_{10.5}Mo_{1.5}N_{1.3}$ powder exhibits good resistance to decomposition. The 1-12 phase accounts for over 96 wt % in the alloy even after the most severe 81 min annealing. $(Ce_{0.2}Nd_{0.8})_{1.1}Fe_{10.5}Mo_{1.5}N_{1.3}$ shows much stronger inclination to decompose at 687° C. (960 K). After having been heated for 81 min, over 30 wt % of 1-12 phase has decomposed into impurity phases such as Fe—Mo and Fe nitrides, and 1-12 phase is less than 70 wt % in the alloy.

Sintered magnets deviate from the decomposition trend lines of the powder and show greater propensity to decompose at lower temperature due to (1) the simple Fe diffusion model used for powder samples assumed atmospheric pressure, while the applied ram pressure of 60 MPa could be a contributing factor to induce a higher Fe diffusion rate during the sintering process; (2) the inhomogeneous temperature field in the green compact during the heating stage may accelerate the decomposition process; and (3) the thermal stability test was performed in an Ar protected environment while SPS was carried out in $N_2$. The more rapid degradation during SPS compared to heating the powder emphasizes the need to minimize time and temperature exposure during consolidation.

Portions of the $(Ce_{0.2}Nd_{0.8})_{1.1}Fe_{10.5}Mo_{1.5}N_{1.3}$ powder were used in a spark plasma sintering process using a die section and a sintering apparatus like that described in connection with FIG. 1. The pulsed DC current was passed through the compacted powder to rapidly heat the powder to predetermined temperatures of 550° C., 600° C., 650° C., 675° C., and 700° C. In the forming of the bulk magnets of this compound, the typical dwelling time at the selected maximum temperature for the sintering was five minutes. Each densified bulk magnet shape was then removed from its forming die. The pressure applied to the powder was 60 MPa except for a pressure of 104 MPa used in forming a comparative sample at 600° C. The formed bulk magnet pieces were 3 mm in diameter and 1.2 to 1.7 mm in height.

The following Table summarizes the physical and extrinsic magnetic properties of bulk $(Ce_{0.2}Nd_{0.8})_{1.1}Fe_{10.5}Mo_{1.5}N_{1.3}$ magnets. A sintering temperature of 600° C. or greater is needed to obtain a dense sample with over 90% of theoretical density. However, when the sintering temperature is greater than 675° C., the magnetic properties worsen precipitously. As expected, increasing pressure is helpful to improve density and is a better alternative in place of higher sintering temperature to retain the desired 1-12 phase. In one example (sintering temperature of 675° C.*) it was found that changing the protective inert gas from nitrogen to argon for the sintering resulted in slightly improved coercivity in the bulk magnet.

TABLE

| $T_{sinter}$ (° C.) | P (MPa) | ρ (g/cm³) | $\rho_{rel}$ (%) | $(BH)_{max}$ (MGOe) | $B_r$ (kG) | $H_{ci}$ (kOe) | $4\pi M_{19}$ (kG) |
|---|---|---|---|---|---|---|---|
| Powder | NA | 8.48 | NA | 5.32 | 6.54 | 3.13 | 9.13 |
| 550 | 60 | 6.58 | 77.6% | 5.11 | 6.59 | 3.22 | 8.92 |
| 600 | 60 | 7.94 | 93.6% | 4.98 | 6.58 | 3.34 | 9.12 |
| 600 | 104 | 8.05 | 94.9% | 4.97 | 6.62 | 3.40 | 9.21 |
| 650 | 60 | 7.70 | 90.8% | 4.61 | 6.60 | 3.11 | 9.18 |
| 675 | 60 | 8.12 | 95.7% | 3.94 | 7.22 | 2.07 | 9.78 |
| 675* | 60 | 7.98 | 94.1% | 3.73 | 6.83 | 2.41 | 9.52 |
| 700 | 60 | 7.66 | 90.3% | 3.29 | 9.94 | 0.45 | 12.21 |

The values of 4πM were obtained at the highest magnetic field of 19 kOe.

Figure 3A:
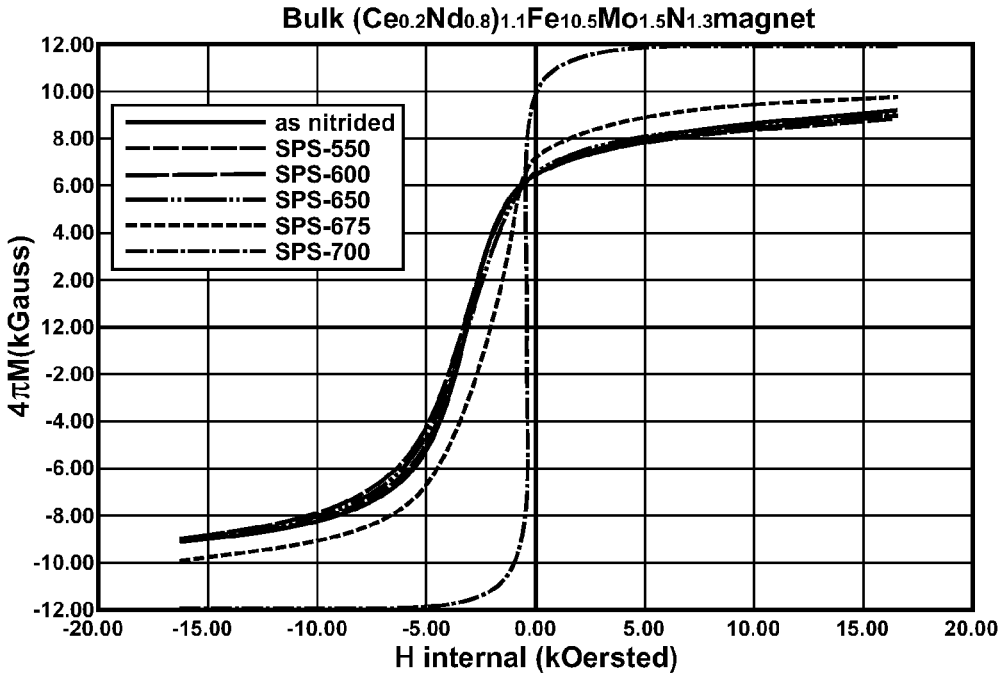
FIG. 3 (*a*) displays room temperature demagnetization curves for as-nitrided $(Ce_{0.2}Nd_{0.8})_{1.1}Fe_{10.5}Mo_{1.5}N_{1.3}$ powder prior to consolidation and for bulk magnets made by SPS.
Figure 3B:
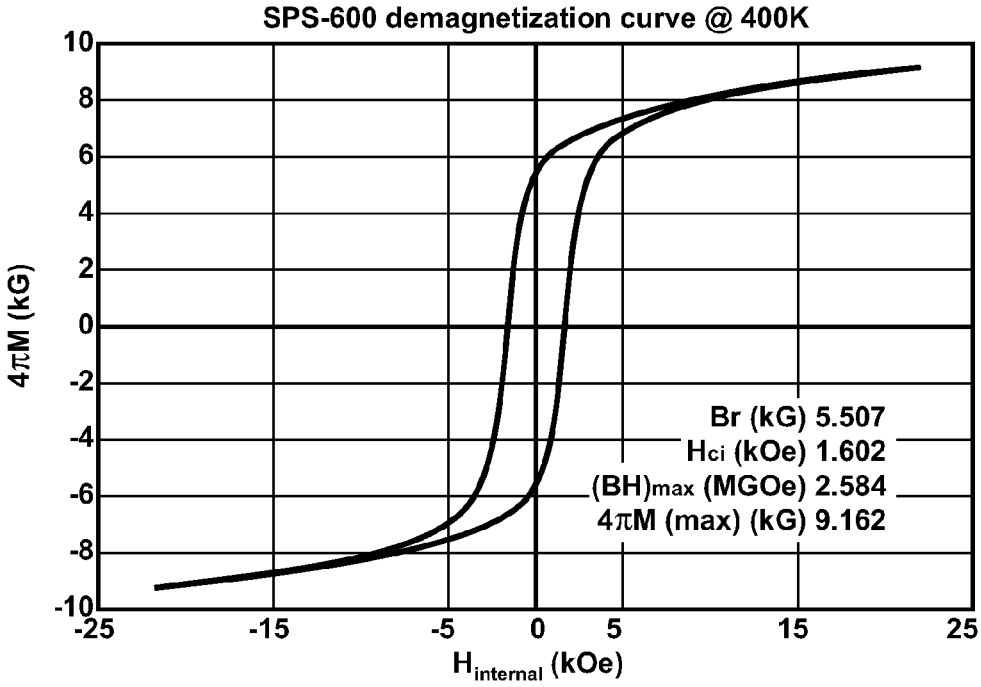

FIG. 3 (*a*) displays room temperature demagnetization curves for as-nitrided $(Ce_{0.2}Nd_{0.8})_{1.1}Fe_{10.5}Mo_{1.5}N_{1.3}$ powder prior to consolidation and bulk magnets made by SPS. The respective demagnetization curves are for the bulk magnets prepared by SPS as described above and in the Table and sintered at 550, 600, 650, 675, and 700 degrees Celsius. Each of the bulk magnets is believed to be magnetically isotropic. As seen in FIG. 3(*a*), except for the samples sintered at or above 675° C., SPS samples have identical demagnetization curves as that of the as-nitrided starting powder, indicating SPS is a viable technique to consolidate metastable 1-12 nitrides.

FIG. 3 (*b*) is the demagnetization curve of the best performing $(Ce_{0.2}Nd_{0.8})_{1.1}Fe_{10.5}Mo_{1.5}N_{1.3}$ magnet SPS-600 (the third entry in the above Table) at 400 K (127° C.). Using the modified Stoner-Wohlfarth model, we estimated that the uniaxial anisotropy $H_a$ is no less than 3.2 T at 127° C. (400 K). Curie temperature $T_c$ of the bulk magnet is 600 K, the same as that of the as-nitrided powder.

In conclusion, metastable $(Ce_{0.2}Nd_{0.8})_{1.1}Fe_{10.5}Mo_{1.5}N_{1.3}$ has been successfully consolidated using a rapid sintering technique SPS. The parameters of the sintering process were devised using selected thermal stability tests. In the case of the selected compound, the tests indicated an opportunity window for sintering the nitrides below 687° C. on the time scale of few minutes. It was also found that the actual SPS sintering conditions increased the propensity for decomposition and lowered the upper sintering temperature limit. The described experimental results indicated a sintering temperature between 600-650° C. was suitable for obtaining dense samples with excellent room temperature magnetic properties. At room temperature, the best performing bulk magnet is 95% dense and has $H_{ci}$=3.4 kOe, remanence $B_r$=6.6 kG, magnetization 4πM=9.2 kG, and energy product $(BH)_{max}$=5.0 MGOe. At elevated temperature of 127° C. (400 K), the sample possesses $H_{ci}$=1.6 kOe, $H_a \geq 3.2$ T, and 4πM=9.2 kG.

In accordance with practices of this invention, a group of $(Ce_{1-x}R_x)_{1+w}Fe_{12-y}M_y$ compounds and of $(Ce_{1-x}R_x)_{1+w}Fe_{12-y}M_yN_z$ compounds can be formed in the form of powder particles having 1-12 tetragonal crystal structures and permanent magnet properties. But the respective particulate compounds could be metastable and tend to decompose upon standard processes for consolidation of the particles into bulk shapes for magnet applications. Particles of each of the respective compounds may be thermally analyzed to determine suitable sintering conditions for consolidation of the particulate compounds by a suitable spark plasma sintering process into useful magnet shapes.

The effects of heating temperatures, heating times, and consolidation pressures on small particles of the respective compounds may be analyzed using practices such as differential scanning calorimetric analysis (DSC) and thermal gravimetric analysis (TGA). The effects of the heating tests on the test samples may be evaluated, for example, by analysis of the crystal structure of the compounds after heating. X-ray diffraction or other electron microscopy may be used to assess phase changes and changes in crystal structure. Also it is found that the use of diffusion models, especially models directed at the diffusion rate of iron, are useful in arriving at suitable conditions for SPS processing of particles of the respective compounds.

Practices of the invention have been illustrated by the use of specific examples which are not intended to limit the scope of the following claims.

The invention claimed is:

1. A method of forming a bulk magnet shape by consolidation, the method comprising:

providing particles of a compound expressed by formula $R_{1+w}Fe_{12-y}M_yN_z$, R is one or more elements selected from the group consisting of Ce, La, Pr, Nd, Sm, Eu, Gd, Tb, Dy, Ho, Er, Tm, Yb, Lu, and Y, w is in the range [−0.1, 0.3], M is one or more elements selected from the group consisting of Mo, Ti, V, Cr, B, Al, Si, P, S, Sc, Ti, V, Co, Ni, Zn, Ga, Ge, Zr, Nb, Hf, Ta, and W; the value of y is in the range [1, 4], N is nitrogen, the value of z is in the range [0.1, 3], and the particles of the compound have a tetragonal crystal structure, corresponding to $ThMn_{12}$ tetragonal crystal structure, and permanent magnet properties, determining a heating temperature, heating period, and consolidation pressure at which a volume of the particles of the compound is consolidated under pressure into a bulk magnet shape, having a density no less than 90% of the density of the original particles, without decomposition of the compound or loss of its tetragonal crystal structure or permanent magnet properties, the determination of the heating temperature, heating period, and compaction pressure for heating and compaction of the particles of the compound into a bulk magnet shape comprising both thermogravimetric analysis and differential scanning calorimetry analysis of the particles and analysis of the crystal structure of particles processed by the thermogravimetric and differential scanning calorimetry analyses, confining a volume of the particles in a die for forming the bulk magnet shape and applying the predetermined compaction pressure for consolidation of the particles while passing a pulsing direct current through the confined volume of particles to heat the particles to the predetermined heating temperature and for the predetermined heating time to produce the bulk magnet shape while retaining the permanent magnet properties of the original particles.

2. The method of claim 1 wherein R is a combination of Ce and Nd and M is molybdenum.

3. The method of claim 1 wherein the value of w is in the range [0.05, 0.15], the value of y is in the range of [1, 2], and the value of z is on the range of [0.5, 1.5].

4. The method of claim 1 wherein the particles of the $R_{1+w}Fe_{12-y}M_yN_z$ compound have maximum dimensions no greater than forty-five micrometers.

5. The method of claim 1 wherein the compound is formed by the reaction of nitrogen gas with particles of a previously formed $R_{1+w}Fe_{12-y}M_y$ compound without increasing the maximum dimensions of the particles to values greater than forty-five micrometers.

6. The method of claim 1 in which an electron microscopy characterization is used in crystal structure analysis of the particles of a the compound which were subjected to the thermogravimetric and differential scanning calorimetry analyses.

7. The method of claim 1 in which the heating period at the selected heating temperature is no more than ten minutes.

* * * * *